United States Patent [19]

Koehler

[11] 4,273,814

[45] Jun. 16, 1981

[54] ARTIFICIAL SHRUBS OF IMPROVED CONSTRUCTION

[75] Inventor: Rudolph A. Koehler, Willowdale, Canada

[73] Assignee: Noma Lites Canada Limited, Scarborough, Canada

[21] Appl. No.: 91,097

[22] Filed: Nov. 5, 1979

[51] Int. Cl.[3] ..... A47G 33/06

[52] U.S. Cl. ..... 428/8; 428/20

[58] Field of Search ..... 428/18, 19, 20, 8

[56] References Cited

U.S. PATENT DOCUMENTS

| | | | |
|---|---|---|---|
| 3,083,824 | 4/1963 | Ness | 428/20 X |
| 3,131,112 | 4/1964 | Abramson | 428/20 X |
| 3,574,102 | 4/1971 | Hermanson | 428/20 X |
| 3,603,780 | 9/1971 | Lu | 428/20 X |
| 4,101,697 | 7/1978 | Dieffenbach et al. | 428/20 X |
| 4,140,823 | 2/1979 | Weskamp | 428/20 X |

*Primary Examiner*—Henry F. Epstein

*Attorney, Agent, or Firm*—Leon Arthurs; Kenneth M. Garrett

[57] ABSTRACT

An artificial tree or the like having an improved holder for the branches thereof is disclosed. The branch holder comprises a support element such as a hub which can form or be attached to the trunk-forming member from which hub support arms extend radially outwardly for support of branches. Each of the support arms includes a bearing adjacent the juncture of the hub and the support arm for receiving therein a pivot element at the end of each branch to be supported therein. The bearing is accessible by way of a passageway which has a trap located therein, which trap is yieldable to permit entry of the pivot element of the branch and is resistant to withdrawal of the branch from the support arm. The configuration of the holder is particularly adapted for unipartite molding with thermoplastic materials in a simple draw die.

21 Claims, 5 Drawing Figures

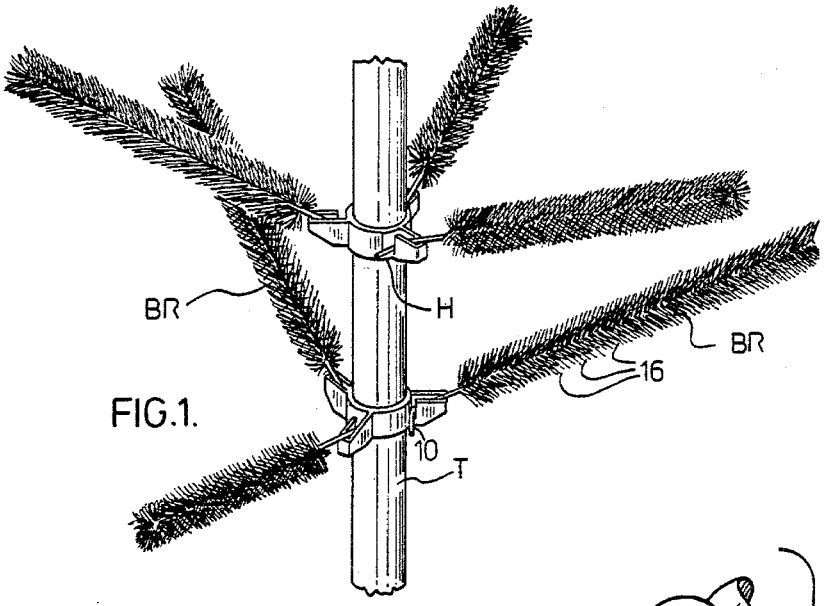
FIG.1.
FIG.2.
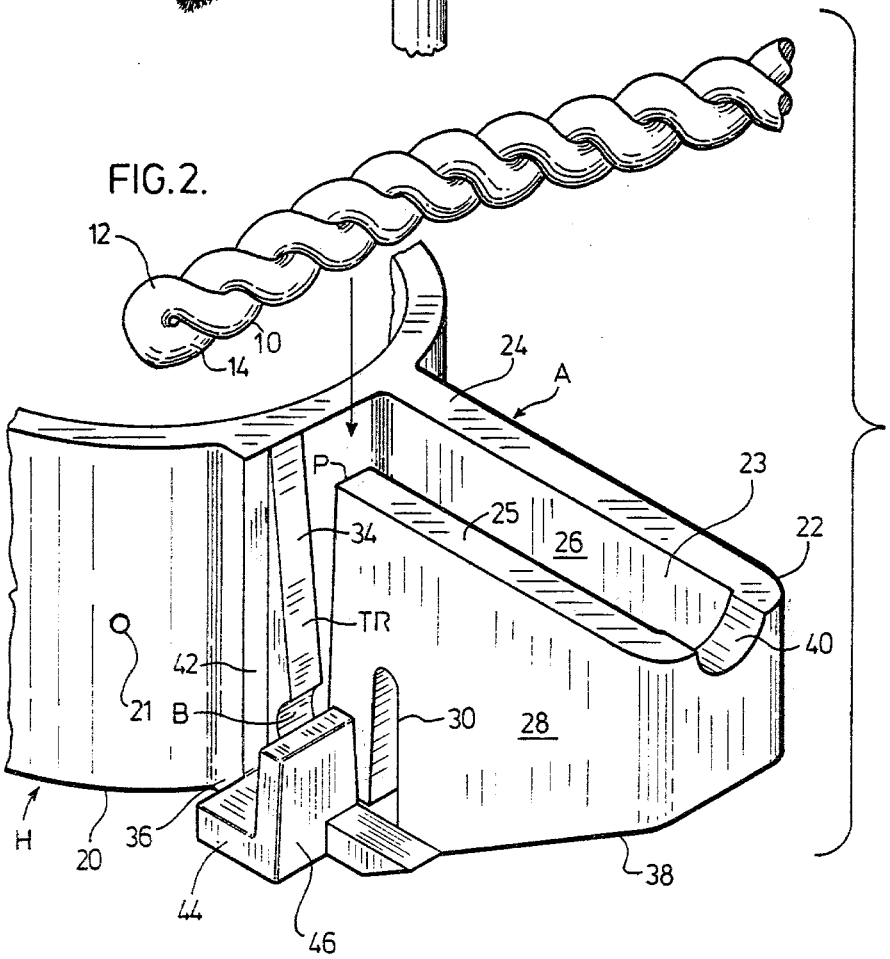

ARTIFICIAL SHRUBS OF IMPROVED CONSTRUCTION

FIELD OF INVENTION

The present invention relates to artificial shrubs, for example Christmas trees. It particularly relates to structure for securing the branches of such shrubs to a central trunk of the tree so as to permit facile user assembly.

PRIOR ART

Artificial shrubs of the type comprehended by the instant invention comprise a central trunk, usually an axially elongated member of circular cross section, and a plurality of branches which are supported from the trunk. In certain known structures the trunk is provided with openings into which an end of a branch, which may for example be of a twisted wire and plastic filament construction, may be inserted by a user. In a second construction the branches may be secured to an intermediate branch support. Generally such branch support forms part of a branch holder, which in turn secures to the trunk. The branch support includes a means for pivoting the branch in an axial plane between a first position in general axial alignment with the trunk, and a second position outstretched therefrom. This type of construction is preferred as it permits the tree to be more readily mounted and dismounted. In the prior art pivotable structures the pivot means in one embodiment thereof necessitates drilling and riveting making this second construction somewhat less competitive economically with the first type. In a second embodiment of the pivotable structure a pivot is molded as a spur into the branch support structure, and a loop formed at the end of a branch is engageable therewith. The loop is maintained in engagement with the pivot by using a separately provided wedge. This structure is amenable to user assembly, but in practise it has been found to be disadvantageous in permitting an undesirable lateral movement (wobbling) of the branches, and in necessitating the provision of a separate component which can be misplaced.

OBJECTS OF THE INVENTION

The present invention seeks to provide in one aspect thereof artificial shrubs permitting easy assembly of the branches with branch supports wherein the desired pivotal movement is achieved without requiring the provision of other components or parts.

The invention contemplates in a further aspect branch supports to the above type which are unipartitely formed by simple molding techniques.

SUMMARY OF THE INVENTION

In accordance with the broad aspects of the present invention there is provided a branch holder for artificial branches of an artificial tree or the like, comprising a central support element; at least one support arm extends outwardly from the central support element and is joined thereto, which arm provides a slot in which a branch is swingable in one plane between one position in which it is folded against the tree trunk and another position in which it is outspread therefrom. A bearing is provided adjacent the juncture of the hub and the support arm for a pivot element at the end of said branch and in which the pivot element is receivable and rotatable to permit swinging of the branch in the slot between the two positions. The holder further comprises a passageway communicating with the slot. The passageway is restricted by a trap which is yieldable to permit insertion of the branch pivot element into a bearing at the bottom on the passageway, but which is resistant to the withdrawal of the pivot element therefrom.

In accordance with more specific aspects of the present invention, the central support element comprises a collar like hub which in turn is securable upon the trunk of the tree. The support arm comprises a radial wall extending outwardly from the hub; this wall has a proximal portion secured to the hub and a distal portion which is laterally spaced from the proximal portion. The distal portion of the radial wall has a downwardly opening cleft therein located so that terminal portions of the distal portion form a resilient detent finger. A ramp surface is provided on the surface of the hub, the ramp surface and detent finger together forming the above passageway and trap. The ramp surface terminates abruptly so that the restriction in the passageway is removed. An outwardly turned end portion of a branch forms a simple pivot element; this pivot element may be forced by a user down the passageway and past the trap, to be received in the bottom portion of the passageway, the walls thereof, together with the terminating ramp surface forming a bearing surface for the pivot element.

Other more specific aspects of the invention will be apparent from the following description of a preferred embodiment thereof, taken in conjunction with the drawings appended hereto.

DESCRIPTION OF THE PREFERRED EMBODIMENT

In the drawings:

FIG. 1 is a perspective view of a branch holder in accordance with the present invention attached to a post constituting the trunk of a Christmas tree or the like ornamental structure of which only a part is shown;

FIG. 2 is a partial perspective view of the holder and a branch ready to be inserted in the holder;

Figure 3:
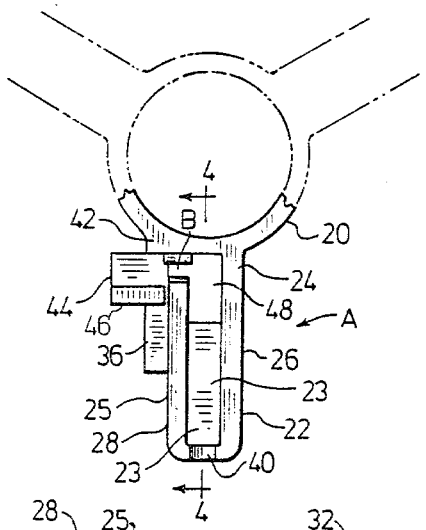
FIG. 3 is a plan view of a support arm of the holder.
Figure 4:
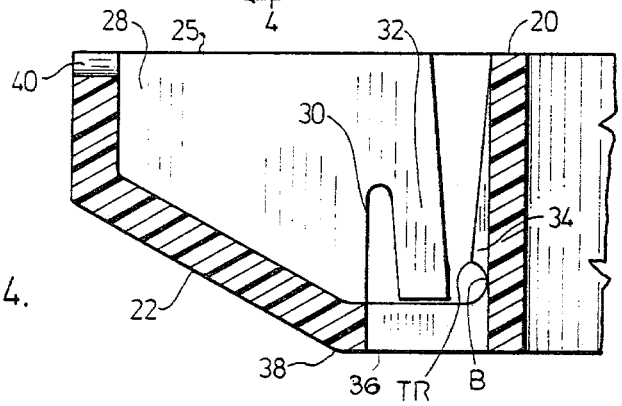
FIG. 4 is a cross-section along line 4—4 in FIG. 3.
Figure 5:
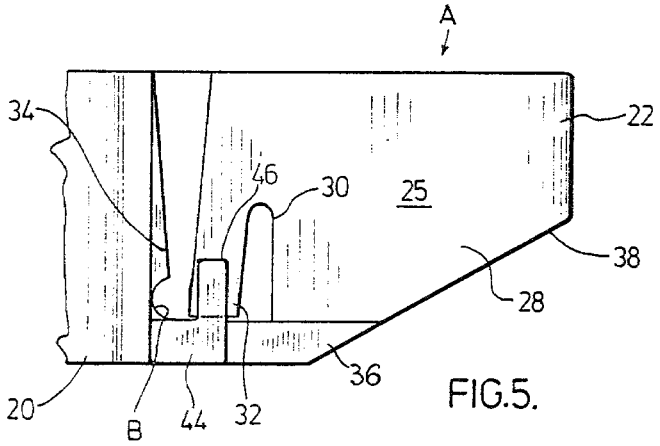
FIG. 5 is an elevational view of a support arm.

Referring to the Figures, a tree trunk T forming part of a Christmas tree or the like decorative structure has attached thereto a branch holder H for branches BR, the holder comprising a plurality of branch support arms A. Merely by way of example, the holder H may have three such branch support arms located generally in radial relation with respect to the trunk T.

The holder serves to support the branches BR in a first position in which they are outspread as shown, and further permits swinging of each branch towards the trunk T so as to provide reduced bulk of the mounted branches during out of season storage.

Each of the branches BR is furnished with a pivot element 10 near the end of the branch which is to be attached to the trunk T by way of the holder H. As shown in FIGS. 1 and 2, the pivot element 10 is here furnished by rectangularly bent end portion of the stem-forming structure of the branch. Again merely by way of example, the branch may be fashioned by two pieces of wire 12 and 14, respectively, which are twisted together with plastic strands 16 intertwined therebetween to form a replica of a pine branch.

Holder H typically is comprised of a hollow cylindrical hub 20 which forms a central support element for support arm A radiating outwardly therefrom. The hub 20 is furnished with a hole 21 in a wall segment adjacent a support arm A for attachment of the holder H to the trunk using a nail or similar fastener, not shown.

Each support arm A comprises a radial wall 22 extending outwardly from a hub 20; the radial wall is formed to provide a radial slot 23 which permits the branch BR to swing in an axial plane between a first outstretched position, for example as shown in FIG. 1, and a second generally upstanding position wherein it is approximately axially aligned. Slot 23 is of a width to provide for a snug fit of the stem of branch BR therein so as to avoid lateral wobbling of the branch, whilst permitting the branch to move between the first and second positions.

As best seen with reference to FIG. 2, radial wall 22 has a proximal portion 24 thereof secured to hub 20 and a distal portion 25 thereof laterally spaced from proximal portion 24 and radially spaced from hub 20. The lateral spacing of wall portions 24 and 25 in part defines slot 23; in this preferred embodiment wall portions 24 and 25 form a continuum of parallel, laterally spaced cheeks 26,28 with slot 23 extending therebetween.

The distal portion 25 of cheek 28 is provided with a downwardly opening cleft 30 therein so as to form a resilient finger 32 which functions as a detent as will be further described. Opposed to detent finger 32 there is provided on hub 20 a ramp surface 34, the ramp surface and detent finger together forming a passageway P which communicates along the length thereof with slot 23. The passageway P is dimensioned at the upper extremity thereof to receive pivot element 10 therein. The ramp surface 34 constricts passageway P, and with the detent finger forms a trap TR for pivot element 10. Ramp surface 34 terminates abruptly so as to remove the constriction, the portion of the passageway beneath the constriction, which portion includes the downwardly facing end of ramp surface 34, forming part of a bearing surface for receiving the trapped pivot element 10 therein.

Passageway P is closed by a stop wall 36 which functions together with the bottom portion of the passageway and ramp surface to form a bearing B for pivot element 10. Stop wall 36 may be supported from hub 20 or arm A. In the preferred embodiment stop wall 36 connects between hub 20 and check 28 radially outwardly of cleft 30, so as to rigidify the support arm. Rigidity is also ensured by interconnecting lower and outer peripheral portions of cheeks 26,28 at 38 so as to in effect form an upwardly opening trough. The upper limit of wall 38 forms a limit to the downward movement of branch BR and is provided with an indent 40 in the uppermost rim to receive branch BR therein.

Branch holder H is desirably formed as a unipartite molding from a thermoplastic material, for example high impact polystyrene. In one form thereof the various undercut surfaces of cleft 30, detent finger 32 and ramp surface 34 may be molded using a split cavity mold technique as will be known to persons in the art. Using such technique stop wall 36 may form a continuum of rigidifying wall 38 if desired. Split cavity molding engenders certain disadvantages, in comparison to draw molding, amongst which are increased mold cost and molding time. Of importance in the present context, the number of support arms that can be formed upon a central support element such as hub 20 is considerably limited when using a split cavity mold. Persons skilled in the art will recognize that in the preferred form of the branch holder H stop wall 36 locates laterally outwardly on cheek 28 and ramp surface 34, as best seen in FIG. 3, and rigidifying wall 38 commences radially outwardly of cleft 30, so as to provide an access opening 48 to all undercut surfaces, whereby a simple straight draw mold may be employed to form branch holder H.

It is generally found to be desirable to increase the surface area of bearing B so as to provide for greater retention of a branch BR in the branch holder H, particularly when in the upright position. For this purpose the wall of hub 20 is thickened at 42 and a small step extension 44 is formed on stop wall 36. Step 44 has a vertical wall portion 46 formed slightly radially outwardly of the lower radially inwardly facing extremity of detent finger 32 so that it combines with the detent finger to form a bearing surface when pivot element 10 is in its engaged position, but it does not impede the passage of the pivot element through trap TR.

Whilst support arms A have been illustrated as being secured to a hub which is in turn secured to the trunk of the tree, it will be recognized that the support arms may be unipartitely formed with the trunk or otherwise attached directly thereto. The illustrated embodiment is deemed to be preferred as its permits reduced molding costs, since the trunk may be extrusion formed whereas the support arms are generally injection molded. Also the separate formation of the parts permits considerable latitude in the aesthetic aspects of the construction and assembly, particularly in regard to branch density and spacing. Other changes from the preferred embodiment may be deemed desirable according to specific circumstances, without departing from the spirit of what has been invented as is described in the following claims.

I claim:

1. A holder for artificial branches of an artificial shrub or the like, said holder comprising:

a central support element;

a support arm extending outwardly from said central support element and joined thereto, said arm providing a slot in which one of said branches is swingable in a plane between one position in which it is generally aligned with said central support element and another position in which it is outspread therefrom;

a bearing adjacent the juncture of the central support element and said support arm for a pivot element at the end of a said branch and in which said pivot element is receivable and rotatable to permit swinging of the branch in said slot between its two positions aforesaid;

a passageway providing the entrance for said pivot element into said bearing;

a trap in said passageway which is yieldable to permit insertion of said pivot element into said bearing and resistant to the withdrawal of said pivot element from said bearing.

2. The holder as claimed in claim 1, further comprising wall means and support means in said support arm for supporting the branch in its outspread position.

3. The holder as claimed in claim 1, wherein said slot is provided by a trough.

4. The holder as claimed in claim 2, wherein said slot is provided by a trough extending outwardly from said central support means.

5. The holder as claimed in claim 3, wherein said channel includes cheeks between which the branch is movable between the positions aforesaid; said passageway being bounded by the central support means on one of its sides and the end of one said cheeks on its other side.

6. The holder as claimed in claim 5, wherein said trap is constituted by:

a ramp in said passageway forming part of said central support element and narrowing the passageway adjacent to said bearing and a resiliently deflectible detent finger constituting the end of the wall bounding said passageway.

7. The holder as claimed in claim 6, wherein said detent finger is provided by a cleft in the cheek bounding said passageway.

8. The holder as claimed in claim 7, including a bottom stop for said passageway.

9. The holder as claimed in claim 1, wherein said central support element is a hub for attachment to a post or the like constituting a tree trunk.

10. The holder as claimed in claim 1, wherein said plurality of said support arms are radially disposed about a hub which constitutes said central support element.

11. A branch holder for a Christmas tree or the like comprising a hub and at least one support arm comprising a radial wall extending outwardly from said hub, said radial wall having a proximal portion secured to said hub and a distal portion laterally spaced from said proximal portion; said radial wall having a slot therein in which the branch is swingable, said distal portion having a downwardly opening cleft therein whereby terminal portions of said distal portion form a resiliently movable detent finger, a ramp surface on said hub opposed to said detent finger, said ramp surface and said detent finger together defining a constricted passageway, said ramp surface terminating abruptly adjacent the bottom end of said passageway to remove the constriction, a stop wall secured to said hub and locating adjacent the bottom of said passageway, said stop wall and the bottom portions of said passageway together forming a bearing for a pivot element of the branch.

12. The branch holder of claim 11 wherein said radial wall comprises a pair of laterally spaced cheeks.

13. The branch holder of claim 12 wherein said cheeks are interconnected by bottom portions thereof to form an upwardly opening trough.

14. The branch holder of claim 12 wherein said cheeks locate in generally parallel vertical planes.

15. The branch holder of claim 13 wherein said bottom portions commence radially outwardly of said cleft opening.

16. The branch holder of claim 11 wherein said stop wall locates laterally outwardly of the surfaces defining said passageway.

17. The branch holder of claim 16 wherein said stop wall connects to said distal portion of said radial wall.

18. The branch holder of claim 16, wherein said stop wall includes a step portion located to increase the bearing surface of said stop wall.

19. The branch holder of claim 11, wherein said radial wall and said stop wall are unipartitely formed with said hub.

20. The branch holder of claim 11, wherein said radial wall and said stop wall are unipartitely formed with said hub by molding a thermoplastic material.

21. The branch holder of claim 11, wherein a plurality of said support arms are radially disposed about said hub.

* * * * *